United States Patent [19]

Venning et al.

[11] 4,450,821

[45] May 29, 1984

[54] GASEOUS FUEL DELIVERY SYSTEM

[75] Inventors: Scott Venning, Mt. Prospect, Ill.; Dennis Discount, Jericho, N.Y.

[73] Assignee: VCD Fuel Systems, Mt. Prospect, Ill.

[21] Appl. No.: 417,629

[22] Filed: Sep. 13, 1982

[51] Int. Cl.[3] ..... F02M 13/08

[52] U.S. Cl. ..... 123/525; 123/575; 261/42; 48/180 R

[58] Field of Search ..... 123/527, 525, 575, 27 GE; 261/42

[56] References Cited

U.S. PATENT DOCUMENTS

| | | | |
|---|---|---|---|
| 1,520,772 | 12/1924 | Ricardo | 123/525 |
| 2,050,978 | 8/1936 | Thatcher | 123/525 |
| 4,068,639 | 1/1978 | Cook | 123/525 |
| 4,227,497 | 10/1980 | Mathieson | 123/575 |
| 4,369,751 | 1/1983 | Batchelor et al. | 123/525 |
| 4,373,493 | 2/1983 | Welsh | 123/525 |

*Primary Examiner*—Charles J. Myhre
*Assistant Examiner*—E. Rollins Cross
*Attorney, Agent, or Firm*—Robert V. Jambor

[57] ABSTRACT

A gaseous fuel delivery system for a gasoline engine having a gaseous fuel delivery valve means comprising an idle fuel delivery valve and an acceleration fuel delivery valve. Means responsive to air flow through the carburetor throat controls operation of the idle fuel delivery valve. Means responsive to intake manifold vacuum controls operation of the acceleration fuel delivery valve. Electrically operable alternately open idle and acceleration solenoid valves are interposed in separate delivery conduits from the idle and acceleration fuel delivery valves. Means responsive to the opening of the acceleration fuel delivery valve opens the acceleration solenoid valve and closes the idle solenoid valve, reversing the respective valve positions on closing of the acceleration fuel delivery valve. An idle switch responsive to idle position of the throttle prevents opening of the idle solenoid valve except when the throttle is in the idle position.

The engine carburetor is arranged such that no gasoline is delivered for idle operation. Idle needle valves are closed, or eliminated. Transition slots are sized to be operational only as the throttle moves from the idle position and supply no fuel when the throttle is at idle.

20 Claims, 8 Drawing Figures

GASEOUS FUEL DELIVERY SYSTEM

BACKGROUND OF THE INVENTION

1. Field of the Invention

The present invention relates to a gaseous fuel delivery system for gasoline engines. More particularly it relates to a system which supplies gaseous fuel, such as propane, methane or natural gas to the gasoline engine during idle and acceleration conditions of operation. It is an improvement of the system described in U.S. Pat. No. 4,227,497.

2. Description of the Prior Art

The system disclosed in the aforesaid patent is intended to supply gaseous fuel to a gasoline engine during portions of the operating cycle in which gaseous fuel operation is more efficient. These selected operating conditions are idle, acceleration, and increased load.

It was determined that the use of purely mechanical means to control idle gaseous fuel supply was troublesome and inaccurate. Also, dependency upon the relative magnitudes of engine vacuum resulted in wide fluctuations in operating effectiveness. Unwanted operation of one or the other portion of the system to supply gaseous fuel when not intended further diminished overall efficiency. Importantly, it also was determined that for idle operation, modification of the carburetor of the gasoline engine equipped for gaseous fuel supply was necessary to maximize efficiency.

SUMMARY OF THE PRESENT INVENTION

The present invention is intended to provide the advantages of gaseous fuel operation in a gasoline engine without the disadvantages of the earlier design. The present invention incorporates means responsive to engine operating conditions into the idle fuel supply portion to the system. It also eliminates variable control of gaseous fuel supply during acceleration and provides positive, electrically operated cutoff of the gaseous fuel supply during periods when such supply is unneeded. This arrangement eliminates the ability to automatically respond to variable load, but significantly improves idle and acceleration performance.

The system of the present invention is applicable to new as well as existing engines. It could be supplied as original equipment or added as a conversion at some later time.

In the preferred form, the system includes supply valve means responsive to absence of flow of air through the carburetor venturi to permit supply of a preselected quantity of gaseous fuel during idle operation of the engine and responsive to loss of intake manifold vacuum to permit supply of a preselected supplemental quantity of gaseous fuel during engine acceleration. It further includes positive electrically operated valve means responsive to engine throttle position and manifold vacuum to insure delivery of idle or acceleration gaseous fuel supply only at the proper portions of the operating cycle.

The carburetor used with the system is arranged such that no gasoline fuel is delivered to the engine at idle, yet as operation is elevated above idle, a small supply of gasoline commences prior to termination of the idle gaseous fuel supply.

Figure 5:
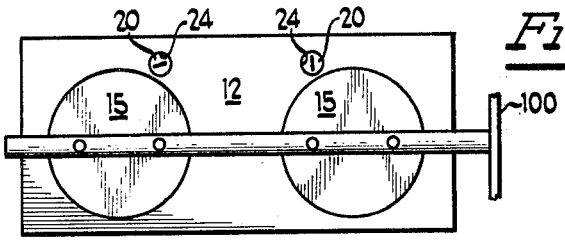
FIG. 5 is a top view of the base plate of the carburetor incorporating the system of the present invention.

FIGS. *6a* and *6b* are fragmentary views of portions of the base plate of the carburetor of FIG. 5.

Figure 7:
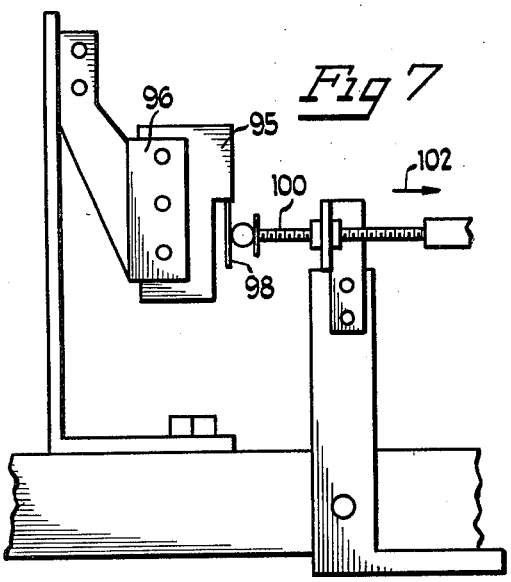

FIG. 7 is a fragmentary side elevational view of a portion of the carburetor of FIG. 5.

DETAILED DESCRIPTION

The system of the present invention is applied in conjunction with the carburetor of an internal combustion engine utilizing gasoline fuel. It is interconnected, for example, with a dual barrel carburetor 10 illustrated in the drawings, which includes a removable base plate 12, central throats 14 and pivotal butterfly valve plates 15 pivotally mounted in base plate 12 and controlled by the engine throttle linkage. Of course, a carburetor having additional or fewer barrels (venturis) could be utilized. Any suitable gasoline carburetor may be used, such as the products of Rochester Carburetor Company, a Division of General Motors Corporation. Specifics of carburetor functions to supply gasoline to an engine are illustrated and described in numerous reference works, such as, for example, "Rochester Carburetor", a publication of H. P. Books, P. O. Box 5367, Tucson, Ariz. 85708, printed 1973, Library of Congress Catalog Card Number 72-91 685. Reference is made to that publication for an understanding of the typical gasoline carburetor with which the present invention is intended to cooperate.

Illustrated carburetor 10 is not wholly conventional. It is modified, or in the instance of original equipment, constructed differently from a carburetor for supplying only gasoline to an internal combustion engine. Carburetor 10 includes gaseous fuel inlet tube 16 through which the gaseous fuel is supplied in accordance with the present invention. This may be located above or below butterflys 15.

In accordance with the present invention, it is necessary to eliminate all supply of gasoline fuel at idle. Usually two sources exist, the main idle circuit, which includes adjustable idle fuel jets and in most carburetors transition slots, which are formed in the throat of carburetor adjacent the closed position of the butterfly valves.

Idle needle valves are closed so that no fuel is delivered to the idle circuit of the carburetor. The idle circuit is normally a passage separate from the throat and supplies gasoline and air even though the butterfly valves are closed or nearly closed. Fuel, metered through the idle needle valves, is the major idle fuel supply. In the present system all gasoline or liquid fuel supply is eliminated at idle.

As illustrated in FIGS. 5 through 7, the carburetor of the present invention includes transition slots 22, formed in throats 14 of carburetor 10, which permit quantities of gasoline to enter the carburetor throat 14. They generally operate to supplement idle fuel supply until the main carburetor jets 17 commence fuel delivery.

Figure 6A:
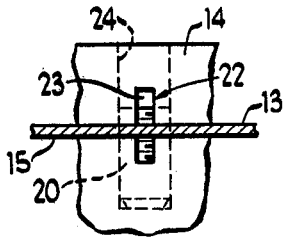
Figure 6B:
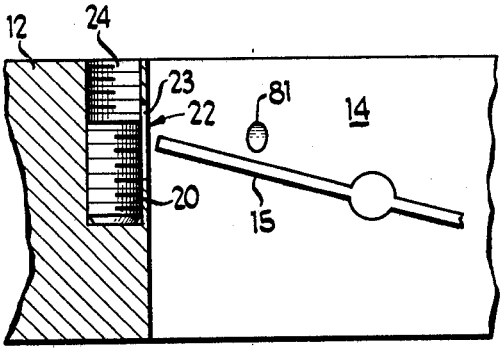

As seen in FIGS. 5, 6*a* and 6*b*, the base plate 12 of carburetor 10 has been modified to significantly shorten the "transition slots" 22 which exist in the walls forming the throats 14, such that they are closed at idle and not exposed to the high intake manifold vacuum between the closed butterflys. Thus, no gasoline can be drawn into the carburetor throat. In modifying an existing carburetor 10 the slots 22 are conveniently restricted by inserting set screws 20 from the top of carburetor base plate 12. Appropriate threaded holes 24 are formed in base plate 12 to accommodate threaded set screws 20.

It is important to note that the screws are positioned such that the transition slots are blocked when the butterfly plate is in the closed or idle position. That position of plate 15 at idle is as shown at 13 in FIG. 6*a*. At idle no gasoline can be drawn into the carburetor through the shortened portions 23 of slots 22, because they are above the closed portion of the butterfly. As the butterflys 15 are moved from the idle position, some amount of gasoline is drawn into the throats 15 through the shortened slots 23. This is intended to avoid any possible lag in operation as transition is made from idle to operational modes. It occurs, because as the butterflys 15 are pivoted toward the open or vertical position, the shortened slots 23 are exposed to the intake manifold vacuum.

The power valves of the carburetor 10 are also eliminated. This is done by removing, or in the case of original equipment, excluding the typical power valves found in a carburetor which enrichens the fuel mixture under load. This substantially reduces the amount of liquid fuel which will enter the carburetor on acceleration.

The fuel delivery system illustrated in the embodiment in FIGS. 1 through 8, includes a pressure vessel 26 for storage of a gaseous fuel supply, a shut-off valve 28, adjustable pressure regulator 30 with gauge 32, supply valve means 34, and connecting delivery conduits 36. The fuel utilized may be propane, methane, natural gas or similar suitable gaseous fuel. The vessel 26 may be placed in any suitable location, for example, in automotive applications it may be placed in the trunk, or between the frame rails.

Regulator 30 and gauge 32 are utilized to set an appropriate supply pressure for delivery of gaseous fuel to the supply valve means 34 at essentially constant present pressure. As can be appreciated, the pressure level will vary with the size of the engine with which the system is associated. Typically, a system for an engine of 200 cubic inch displacement will operate satisfactorily at 1.5 to 2.0 psig. (pounds per square inch, gauge) supply pressure.

Fuel supply line 36 provides a connection between regulator 30 and supply valve means 34. Interposed in line 36 is a normally closed solenoid valve 38 connected to the electrical power supply of the engine, which in this embodiment includes battery 41. Solenoid 38 is operated by oil pressure switch 39 which closes the electrical circuit and permits solenoid 38 to open only when the engine is cranking and has developed oil pressure.

Figure 3:
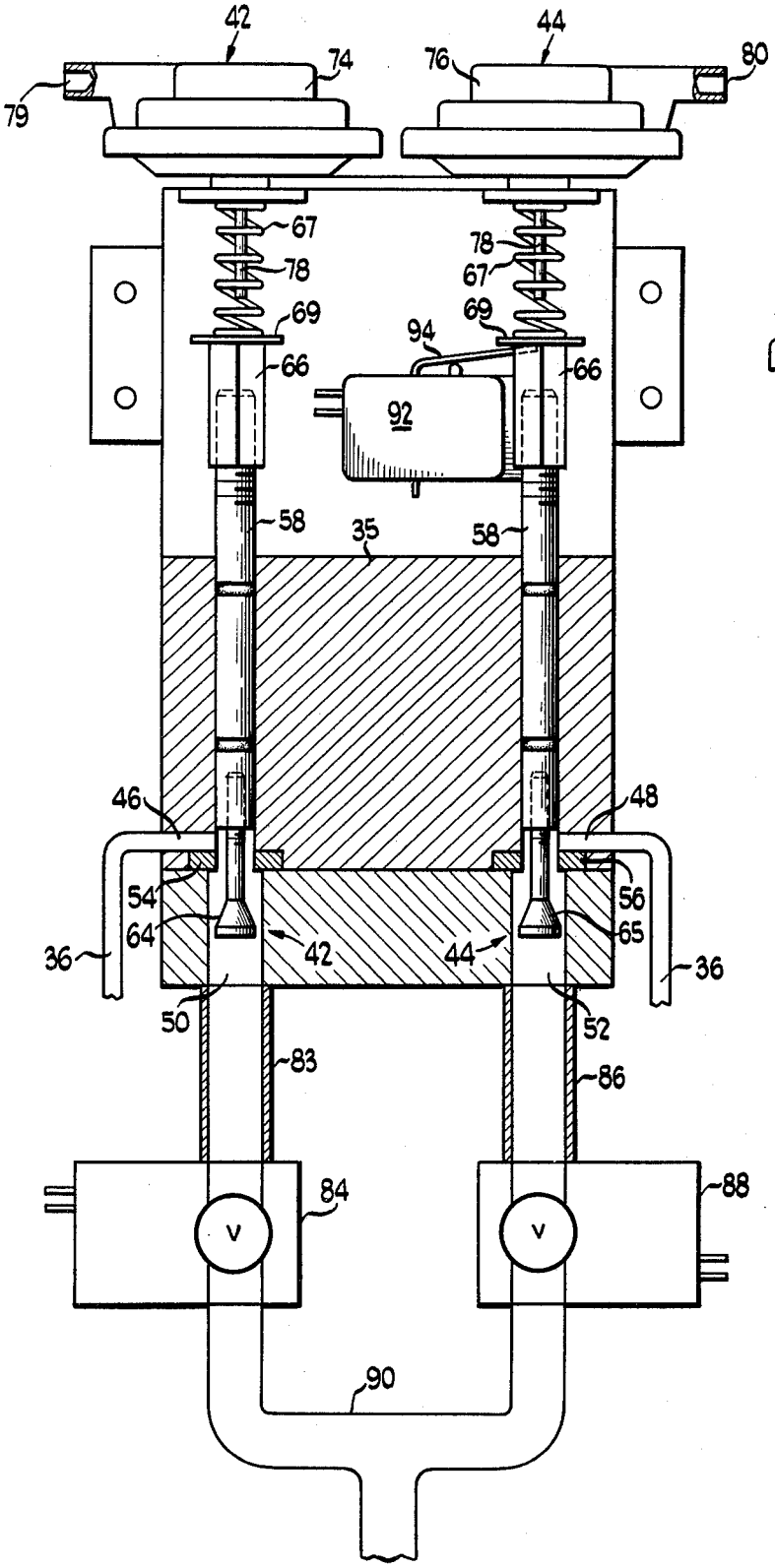
FIG. 3 is a plan view, partially in section, of the supply valve means of the present invention.

As best seen in FIG. 3, supply valve means 34 includes a housing or body 35 forming two separate valves, idle fuel valve 42 and acceleration fuel valve 44. Supply line 36 delivers gaseous fuel through two separate inlet passages 46 and 48. These passages respectively connect to two separate discharge passages 50 and 52 across orifice defining valve seats 54 and 56.

Each of the valves 42 and 44 includes rod 58 slidably supported in bores formed in body 35. Tapered lower portions of the rods form valve plugs 64 and 65 which coact with valve seats 54, 56 to open and close communication between passages 46 and 50 and passages 48 and 52. The plugs are tapered to provide adjustability of effective orifice size of the annular opening between plug and seat when the valves are in the open position. The maximum diameter of the tapered portions exceeds the orifice size of the seats 54, 56 so that when the valves are in the closed position the orifices are completely closed.

Upper ends of rods 58 are threaded into adjustment nuts 66 which are adjustable to vary the length of the rod, nut combination, and consequently the effective orifice size of the annulus between seats 54, 56 and plugs 64, 65. It has been determined that the effective orifice size (equivalent circular orifice) for the valve 42 is in the range of 0.040 to 0.070 inches diameter and the effective orifice size for the valve 44 is in the range of 0.060 to 0.080 inches diameter. Springs 67 operate against washers 69 and urge valve rods 58 toward the open position.

Each of the rods 58 is connected to a vacuum pulloff 74, 76, through connectors 58. These vacuum motors operate, as will be explained, to seat the tapered plugs 64, 65 against seats 54, 56 under appropriate operating conditions. These devices are well known and commercially available from F&B Mfg. Co., Catalogue No. 30-3. F&B Mfg. Co. is located at 4248 West Chicago Avenue, Chicago, Ill.

Figure 1:
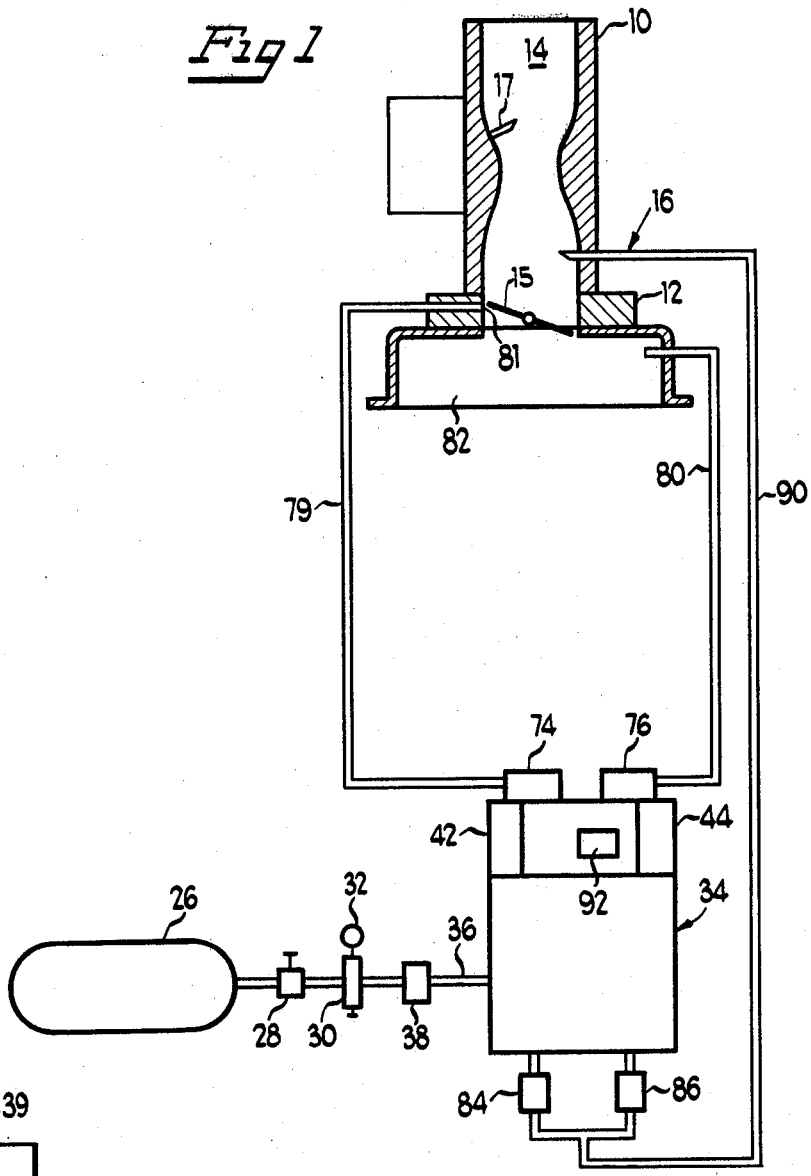
FIG. 1 is a partially sectional view of the system of the present invention.

Vacuum pulloff 74 is connected via conduit 79 to the port 81 in venturi or throat of caburetor 10. Port 81 is located as would be a vacuum advance port in the throat of a carburetor. It is positioned upstream of the butterflys 15 such that when the throttle is closed and butterflys 15 are positioned as shown in FIGS. 1 and 6, the butterflys are between the port 81 and the intake manifold. When the butterflys are moved to an open position, port 81 is exposed to intake manifold vacuum and the flow of air through the throat 14.

Conduit 79 senses ported vacuum, that is, vacuum created as a result of flow of air through the venturi flowing over port 81 and operates to pull rod 58 of idle fuel valve 42 closed when there is sufficient air flow through the carburetor throat. This occurs when the engine is operating other than at idle conditions. At idle, the ported vacuum orifice 81 is blocked or disposed above the butterfly and it does not experience the intake manifold vacuum below the butterflys 15. Hence, there is no flow across it and no ported vacuum. Spring 67 urges valve 42 open. Vacuum pulloff 74 is sized such that open experiencing a ported vacuum in excess of about 4–6 inches of mercury, it will operate against spring 67 and close idle valve 42.

It should be understood that vacuum is a negative valve. That is, a vacuum near zero, measured in inches of mercury, is a smaller or lesser vacuum than a vacuum of 4 or 10 inches of mercury.

Vacuum pulloff 76 is connected via conduit 80 to the intake manifold 82 of the engine incorporating the supplemental fuel delivery system. It senses, and responds to, manifold vacuum to pull the valve rod 58 of acceleration fuel valve 44 closed when manifold vacuum exits, such as during idle and cruise operation. Vacuum pulloff 76 is sized such that upon experiencing an intake manifold vacuum in excess of about 4–6 inches of mercury, it operates against spring 67 to close acceleration fuel supply valve 44.

Discharge port or passage 50 of idle fuel valve 42 communicates through conduit 83 to normally closed idle solenoid valve 84. Discharge port or passage 52 of acceleration fuel valve 44 communicates through conduit 86 to normally closed acceleration solenoid valve 88. These valves then communicate through conduit 90 to gaseous fuel inlet tube 16 in carburetor 10. The solenoid valves may be Skinner #BZ DA 1052 valve or like valves from other sources. Skinner valves are made by Skinner Electric Valve Co., New Britain, Conn.

Figure 4:
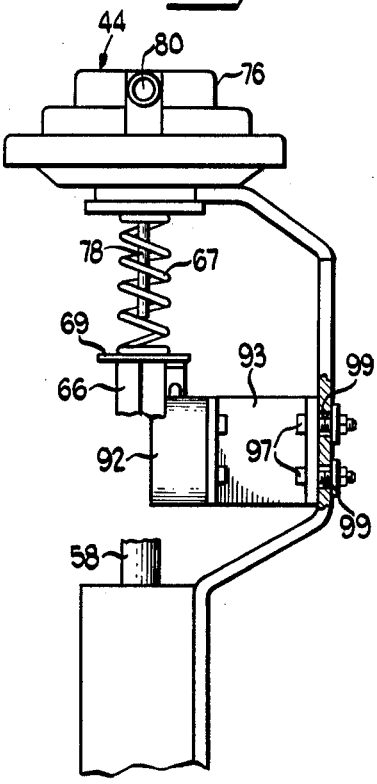
FIG. 4 is a side view of the supply valve means of FIG. 3.

Microswitch 92, as best seen in FIG. 4, is mounted upon bracket 93 connected to body 35 of the supply valve means 34. It is a two position electrical switch with contacts A and B which may be alternately energized. A suitable switch is a UNIMAX 3TMT 15-4 available from G-C Electronics, Rockford, Ill. It senses the position of washer 69 of acceleration valve 44 to operate the switch between contacts A and B and alternately supply power to solenoids 88 and 84. As shown in FIG. 4, bracket 93 is attached to the body 35 with bolts 97 received in slotted holes 99. This permits vertical adjustment of the switch for purposes as will be explained. Also, in the illustrated embodiment solenoids 84 and 88 are normally closed valves; that is, they are closed when de-energized. As can be appreciated, appropriate circuit modification could readily be accomplished and normally open valves used.

Figure 2:
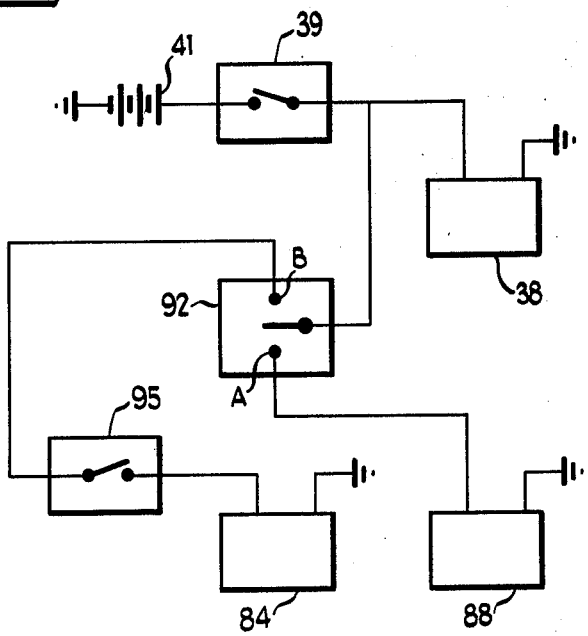
FIG. 2 is an electrical schematic of the electrical components of the system.

At idle, vacuum pulloff 76 experiences high vacuum in the range of 15–17 inches of Mercury. This holds valve 44 closed and seats plug 65 against seat 56. Feeler 94 of switch 92 senses the closed position of valve 44 and as illustrated by the schematic of FIG. 2, connects with contact B to make power available to idle solenoid 84 which opens conduit 83 to conduit 90. At the same time, solenoid 88 is deenergized. This closes conduit 86 from conduit 90 to preclude any flow of gaseous fuel through acceleration valve 44 during idle, even if plug 65 is not tightly sealed against seat 56.

When intake manifold vacuum drops below 4–6 inches of mercury, such as during conditions of acceleration, spring 67 of valve 44 moves plug 65 away from seat 56. Feeler 94 senses the lower position of rod 58 of that valve and in accordance with the circuit of FIG. 2, makes contact at A. Power is no longer available to solenoid 84 which opens and blocks possible flow of gaseous fuel through conduit 83 to conduit 90. Contact A energizes solenoid 88 which permits passage of gaseous fuel through conduit 86 to conduit 90.

When operating at a stable or steady state condition above idle, both pulloffs 84 and 76 experience sufficient vacuum to close respective valves 42 and 44 so that no gaseous fuel is supplied to the carbuetor 10. Also, the closed position of valve 44 is sensed by switch 92 to close solenoid 88, though this action does again make power available to solenoid 84.

To insure operation of the idle fuel supply valve 42 only at idle conditions, a second microswitch 95 is positioned upon carburetor 10 to sense the position of the throttle linkage. A UNIMAX #2HB113-1 is a suitable switch for this application. As best seen in FIG. 7, normally open microswitch 95 is positioned on a bracket 96 with actuator arm 98 disposed to contact throttle linkage 100. Movement of linkage 100 away from idle as shown by arrow 102 causes linkage 100 to move away from actuator 98 and open microswitch 95. Switch 95 is connected in series with switch 92 and and solenoid 84 as shown in FIG. 2.

Starting is initiated by cranking with any suitable cranking motor. This develops sufficient engine oil pressure to close switch 39 to connect the electric circuit to the battery 41. The normally closed solenoid valve 38 is energized and gaseous fuel is made available to the supply valve means 34.

Starting normally requires more air flow into the engine than is available with a closed throttle, so throttle linkage 100 is operated to at least partially open butterfly 15. This permits air to enter the intake manifold 82 through venturi 14, which draws gasoline through main jet 17. Throttle movement also supplies gasoline for starting through conventional accelerator pumps (not shown) in the carburetor.

At the commencement of engine start-up, both vacuum pulloffs 74 and 76 experience zero vacuum and, hence, valves 42 and 44 are open across the orifice seats 54 and 56. The open position of valve 44 positions switch 92 such that contact A is converted to the power source and power is supplied only to solenoid 88. Some gaseous fuel, therefore, is at least initially supplied on startup through the acceleration valve 44.

After the engine starts, sufficient intake manifold vacuum develops, i.e., 4–6 inches of mercury, and pulloff 76 closes valve 44. This causes switch 92 to close contact B and open contact A to supply power to solenoid 84 and de-energize solenoid 88. Gaseous fuel flow through valve 44 is terminated. Additionally, there is no flow through valve 42, even though electrical energy is available to solenoid 84 because switch 95 is open during starting as a result of the open position of throttle butterfly 15. Once the engine starts, flow of air through venturi 14 creates sufficient ported vacuum, i.e., 4–6 inches of mercury, at port 81 of conduit 79 to close valve 42. Also, throttle linkage 100 is in other than the idle position and switch 94 remains open.

Placement of the throttle in the idle position, as illustrated in the drawings, severely restricts air flow into the engine. This air flow passes through the slight annulus between throats 14 and butterflys 15, or through holes drilled in the butterflys for that purpose. Throttle plates 15 are nearly against screws 20 in the shortened transition slots 22. The open portions 23 are above the butterflys. No fuel enters through the shortened slots.

Restricted flow causes loss of ported vacuum, i.e., to less than 4 inches of mercury. Intake manifold vacuum increases substantially to the range of 17–18 inches of mercury. Pulloff 74 no longer operates against spring 67 and, therefore, the valve 42 opens permitting flow across orifice seat 54 into conduit 83. At the same time, pulloff 76 operates against spring 67 to close valve 44. Switch 92 senses the closed position of the valve and connects electrical power to contact B, energizing and opening solenoid 84 and closing solenoid 88.

Linkage 100 is in the idle position and, therefore, switch 95 is also closed, which permits the closure of contact B of switch 92 to energize and open solenoid 84. Gaseous fuel is permitted to flow into the carburetor through conduit 90 and inlet tube 16.

Modified transition slots permit elevation of the power level of the engine from idle without lag or sudden drop in engine output. As butterfly valve 15 is opened, the shortened portions 23 of the slots are exposed to intake manifold vacuum and the air flowing through venturi 14 draws gasoline from the reduced size transition slot. Also, as the butterflys 15 open above the port 81, it is exposed to intake manifold vacuum. Also, air flow past butterflys 15 increases. These factors increase ported vacuum and commence closure of gaseous idle fuel valve 42. As throttle linkage is moved from idle, switch 95 opens and de-energizes solenoid 84, further insuring termination of gaseous fuel supply through conduit 83. Transition slots 23, however, permit gasoline flow as soon as butterflys 15 are moved above the set screws 20. This opens slots 23 to intake manifold vacuum and allows liquid fuel to be delivered simultaneously with, or immediately prior to termination of idle gaseous fuel supply.

Under normal load, butterflys 15 are open to a position dependent on load requirements. Air flow through venturi 14 creates sufficient ported vacuum, i.e., over 4–6 psig. inches of mercury, to cause pulloff 74 to hold valve 42 closed. There is also sufficient intake manifold vacuum, i.e., in excess of 4–6 inches of mercury, to cause pulloff 76 to hold valve 44 closed. Electrically, switch 92 closes contact B, thus de-energizing solenoid 88 and making power available to solenoid 84. Throttle linkage 100, however, is out of the idle position. Hence, switch 95 is open and solenoid 84 remains deenergized. Under these conditions, fuel is supplied solely in liquid form through carburetor 10.

On acceleration, throttle 100 is operated to further open butterfly 15. This results in a loss of intake manifold vacuum. As that parameter reduces to 4–6 inches of mercury or less, vacuum pulloff 74 no longer is capable of holding valve 44 closed against the action of spring 67. As valve 44 opens, switch 92 operates to contact A and energize solenoid 88. Solenoid 84 is disconnected from the source of power and is therefore closed.

Opening of valve 44 permits gaseous fuel to pass between orifice valve seat 56 and plug 65 into passage or conduit 86. Since solenoid 88 is open, gaseous fuel is permitted to flow into conduit 90 and delivery tube 16 to supplement gasoline drawn into carburetor 10 through jet 17. Use of gaseous fuel to supplement gasoline under acceleration is advantageous because gaseous fuel is of a higher octane and enrichens the total fuel mixture using less fuel than if operated on liquid fuel alone.

Once steady state load conditions are reached, throttle butterflys 15 are moved toward a more closed position and intake manifold vacuum again exceeds 4–6 inches of mercury. This closes valve 44 to shut-off acceleration gaseous fuel supply. Also, this movement operates switch 92 to contact B, de-energizing solenoid 88. Since throttle linkage 100 is not in the idle position, switch 95 causes solenoid 84 to remain de-energized and no gaseous fuel is supplied to the engine until a condition of idle or acceleration is re-established.

It has been determined that under certain conditions of light acceleration intake manifold vacuum does not fall below the minimum at which spring 67 of valve 44 can fully override pulloff 76. At the same time, ported vacuum may also drop with the possibility that valve 42 may move slightly open.

Microswitch 92 is mounted on body 35 by bracket 93 such that it may be adjusted vertically. In this way it may be adjusted to respond to different positions of washer 69 dependent upon operating characteristics desired. Positioning of switch 92 vertically with respect to valve 44 dictates when switch 92 will close contact A, and, hence, energize solenoid 88 and de-energize solenoid 84. This switch may be positioned to respond to slight movement of rod 58, or may be moved vertically lower to respond only when the valve rod has nearly reached the end of its opening travel. If positioned in its vertically upward maximum location, it will respond to movement of valve stem 58 of valve 44 as soon as intake manifold vacuum begins to reduce below 4–6 inches of mercury, which represents the commencement of opening of plug 65 from seat 56. If positioned at the vertically lowermost position, it will not sense movement of valve rod 58 by spring 67 until the annulus between plug 65 and seat 56 is fully open. This would, for example, require reduction of intake manifold vacuum to 2–3 inches of mercury. In this way, opening of solenoid 88 can be controlled to occur at a predetermined desired condition of acceleration.

Various features of the present invention have, hence, been disclosed in connection with the illustrated embodiments of the present invention. However, numerous modifications may be made without departing from the spirit and scope of the invention as defined by the appended claims.

We claim:

1. A gaseous fuel delivery system as for an internal combustion engine normally operable on liquid fuel, the combination comprising:

a. idle delivery means responsive to engine operating conditions to supply gaseous fuel to said engine when said engine is operating at idle;

b. acceleration delivery means responsive to engine operating conditions to supply gaseous fuel to said engine when said engine is accelerating;

c. conduit means communicating said idle and acceleration delivery means to a source of gaseous fuel and to said engine wherein said system includes:

a. means responsive to ported vacuum created by flow of air into said engine to open and close said idle delivery means; said means opening said idle delivery means when said engine is at idle and closing said idle delivery means when said engine is operating at other than idle;

b. means responsive to the vacuum in the intake manifold of said engine to open and close said acceleration delivery means.

2. A gaseous fuel delivery system for an internal combustion engine as claimed in claim 1 wherein said system includes:

means closing communication from said idle delivery means to said conduit to the engine when said acceleration delivery means is open, and opening communication from said acceleration delivery means to said conduit to the engine said means further opening communication from said idle delivery means to said conduit to the engine when said acceleration delivery means is open and closing communication from said acceleration delivery means to said conduit to the engine.

3. A gaseous fuel delivery system as claimed in claim 1 wherein said idle delivery means includes an idle fuel delivery valve and said acceleration delivery means includes an acceleration fuel delivery valve.

4. A gaseous fuel delivery system as claimed in claim 3 wherein said system includes:

a vacuum pulloff connected to said idle fuel delivery valve responsive to ported vacuum created by flow of air into said engine to open and close said idle delivery means and a vacuum pulloff connected to said acceleration fuel delivery valve responsive to intake manifold vacuum of said engine to open and close said acceleration delivery valve.

5. A gaseous fuel delivery system as claimed in claim 4 wherein said system includes:

a. an idle solenoid valve intermediate said idle delivery valve and said engine;

b. an acceleration solenoid valve intermediate said acceleration delivery valve and said engine; and c. means responsive to the opening and closing of said acceleration delivery valve to open said acceleration solenoid valve and close said idle solenoid valve when said acceleration delivery valve is open and to close said acceleration solenoid and open said idle solenoid when said acceleration delivery valve is closed.

6. A gaseous fuel delivery system as claimed in claim 5 wherein said system further includes means responsive to the position of the throttle of said engine to permit opening of said idle solenoid valve only when said engine throttle is at the idle position.

7. A gaseous fuel delivery system as claimed in claim 6 wherein said means responsive to the opening and closing of said acceleration delivery valve and said means responsive to the idle position of said throttle of the engine are electrical switches connected to said solenoid valves and adapted to connect to a source of electrical power.

8. A gaseous fuel delivery system for an internal combustion engine as claimed in claim 4 wherein said vacuum pulloff connected to said idle fuel delivery valve opens said valve when the ported vacuum is about 4 to 6 inches of mercury or less.

9. A gaseous fuel delivery system for an internal combustion engine as claimed in claim 4 wherein said vacuum pulloff connected to said acceleration fuel delivery valve opens said valve when said engine intake manifold vacuum is about 4 to 6 inches of mercury or less.

10. A gaseous fuel delivery system as claimed in claim 9 wherein said vacuum pulloff connected idle fuel delivery valve opens said valve when the ported vacuum is about 4 to 6 inches of mercury or less, and said vacuum pulloff connected to said acceleration fuel delivery valve opens said valve when said engine intake manifold vacuum is about 4 to 6 inches of mercury or less.

11. A gaseous fuel delivery system for an internal combustion engine, operable on liquid fuel, comprising:

a. a supply of gaseous fuel under pressure;

b. a gaseous fuel delivery valve means having:

(1) an idle fuel delivery valve;

(2) an acceleration fuel delivery valve;

c. means responsive to engine operation to control opening and closing of said fuel delivery valve means including:

(1) means responsive to ported vacuum to open and close idle fuel delivery valve;

(2) means responsive to intake manifold vacuum to open and close acceleration fuel delivery valve;

d. Conduit means communicating said gaseous fuel from said supply to said delivery valve means and from each said idle fuel delivery valve and acceleration fuel delivery valve to said engine;

e. electrically operable solenoid valve means arranged for alternate opening and closing comprising:

(1) idle solenoid valve means adapted to open and close said conduit means from said idle fuel delivery valve to said engine;

(2) acceleration solenoid valve means adapted to open and close said conduit means from said idle fuel delivery valve;

said means responsive to engine operation further including switch means to alternately open one said solenoid valve means and close the other thereof in response to opening and closing of said acceleration fuel delivery valve, said switch means opening said acceleration solenoid valve when said acceleration fuel delivery valve is open, closing said idle solenoid valve and, opening said idle solenoid valve when said acceleration fuel delivery valve is closed, said closing acceleration solenoid valve.

12. A gaseous fuel delivery system for an internal combustion engine as claimed in claim 11 including solenoid valve means, interposed in said conduit from said supply to said delivery valve means and switch means responsive to oil pressure in said engine to operate said solenoid valve means to permit gaseous fuel flow only when oil pressure exists in said engine.

13. A gaseous fuel delivery system for an internal combustion engine as claimed in claim 11 further including idle switch means responsive to the position of the throttle of said engine to permit opening of said idle fuel delivery valve only when said throttle is in the idle position, closing said valve when said throttle is other than at the idle position.

14. Gaseous fuel delivery system for an internal combustion engine as claimed in claim 13 wherein said:

idle fuel delivery valve and said acceleration fuel delivery valve each include an orifice defining valve seat, a slidable rod having a plug at one end thereof surrounded by said valve seat to define a flow orifice therebetween, each said rod being movable engaging said plug with said orifice seat to close said valve.

15. A gaseous fuel delivery system for an internal combustion engine as claimed in claim 14 wherein said idle fuel delivery valves include means urging said plug to an open position, and a vacuum pulloff connected to sense ported vacuum to close said valve when said ported vacuum exceeds a predetermined minimum, allowing said valve to open when said ported vacuum falls below said predetermined minimum.

16. A gaseous fuel delivery system for an internal combustion engine as claimed in claim 14 wherein said acceleration fuel delivery valve includes means urging said plug to an open position, a vacuum pulloff connected to sense intake manifold vacuum to close said valve when said intake manifold vacuum exceeds a predetermined minimum, allowing said valve to open when said ported vacuum falls below said predetermined minimum.

17. A gaseous fuel delivery system for an internal carburetor engine as claimed in claim 15 wherein gaseous fuel is supplied to said fuel delivery valve means at from 1½ to 2 pounds per square inch and said orifice deferred by said idle fuel delivery valve is equivalent in size to a circular opening housing a diameter of 0.040 to 0.070 inches.

18. A gaseous fuel delivery system for an internal combustion engine as claimed in claim 16 wherein gaseous fuel is supplied to said gaseous fuel delivery valve means at from 1½ to 2 pounds per square inch and said flow orifice defined by said acceleration fuel delivery valve is equivalent in size to a circular opening having a diameter of 0.060 to 0.080 inches.

19. A gaseous fuel delivery system as claimed in claim 15 wherein said pulloff closes said idle fuel delivery valve when ported vacuum exceeds 4–5 inches of mercury.

20. A gaseous fuel delivery system as claimed in claim 16 wherein said pulloff closes said acceleration fuel delivery valve when said intake manifold vacuum exceeds 4–6 inches of mercury.

* * * * *